US010724549B2

(12) United States Patent
Le et al.

(10) Patent No.: US 10,724,549 B2
(45) Date of Patent: Jul. 28, 2020

(54) MASSAGE CHAIR HAVING A NOISE-REDUCING, ENCLOSURE DEVICE

(71) Applicants: Kevin Le, Richland Hills, TX (US); Thanh Le, Grand Prairie, TX (US); Varad Nitin Gokhale, Irving, TX (US)

(72) Inventors: Kevin Le, Richland Hills, TX (US); Thanh Le, Grand Prairie, TX (US); Varad Nitin Gokhale, Irving, TX (US)

(73) Assignee: Luraco, Inc., Arlington, TX (US)

( * ) Notice: Subject to any disclaimer, the term of this patent is extended or adjusted under 35 U.S.C. 154(b) by 468 days.

(21) Appl. No.: 15/593,320

(22) Filed: May 11, 2017

(65) Prior Publication Data

US 2018/0328385 A1 Nov. 15, 2018

(51) Int. Cl.

*F04D 29/66* (2006.01)
*A61H 9/00* (2006.01)
*F04D 29/40* (2006.01)

(52) U.S. Cl.

CPC ..... *F04D 29/664* (2013.01); *A61H 9/005* (2013.01); *F04D 29/40* (2013.01); *A61H 2201/0103* (2013.01); *A61H 2201/0149* (2013.01); *A61H 2201/1238* (2013.01); *A61H 2201/164* (2013.01); *A61H 2201/1609* (2013.01);

(Continued)

(58) Field of Classification Search

CPC ..... A61H 9/0078; A61H 9/005; F04B 53/002; F04D 29/664
USPC ..... 601/86, 90, 98, 91
See application file for complete search history.

(56) References Cited

U.S. PATENT DOCUMENTS 2,751,971 A 6/1956 Gentsch
2,891,538 A * 6/1959 Moxley ..... A61H 23/0254 601/56
3,483,862 A 12/1969 Takeuchi (Continued)

FOREIGN PATENT DOCUMENTS

CN 1446529 A 12/2002
CN 100398081 C 7/2008

(Continued)

OTHER PUBLICATIONS

"MassageChairStore.com," downloaded Sep. 12, 2013, <URL:http://www.massagechairstore.com/ >.

(Continued)

*Primary Examiner* — Bradley H Philips
*Assistant Examiner* — Savannah L Gabriel
(74) *Attorney, Agent, or Firm* — Hoang Steve Ngo

(57) ABSTRACT

The present invention is directed to a massage chair having a massage chair frame, a massage system, and a noise-reducing, enclosure device. The massage chair frame includes a first end, a second end, a seat body area portion, and a back body area portion. The massage system includes at least one fluid massage element, a fluid pump, and at least one fluid valve device for regulating fluid flow into and out of the at least one fluid massage element. The noise-reducing, enclosure device includes an enclosure housing and noise-reducing material positioned inside the enclosure housing. The enclosure housing encloses the fluid pump and the plurality of fluid valve devices during operation such that noise generated from or made by the fluid pump and the plurality of fluid valve devices during operation is reduced, contained or eliminated.

23 Claims, 14 Drawing Sheets

(52) U.S. Cl.
CPC ..... *A61H 2201/1614* (2013.01); *A61H 2201/1623* (2013.01); *A61H 2201/5056* (2013.01)

(56) References Cited

U.S. PATENT DOCUMENTS 3,532,089 A 10/1970 Arntzenius
4,231,355 A 11/1980 Hara
4,422,448 A 12/1983 Sugai et al.
4,422,449 A 12/1983 Hamabe
4,574,786 A 3/1986 Hashimoto et al.
5,020,518 A 6/1991 Spears et al.
5,233,973 A 8/1993 Gill et al.
5,304,112 A 4/1994 Mrklas et al.
5,407,330 A * 4/1995 Rimington ..... F04C 29/066 181/202
5,769,799 A 6/1998 Daughtry
5,792,047 A 8/1998 Coggins
5,827,205 A 10/1998 Iwamoto
5,876,359 A 3/1999 Bock et al.
5,993,401 A 11/1999 Inbe et al.
6,056,707 A 5/2000 Hayashi
6,168,392 B1 * 1/2001 Takano ..... A01K 63/047 417/312
6,171,266 B1 1/2001 Inada et al.
6,224,563 B1 5/2001 Nonoue et al.
6,312,400 B1 11/2001 Itikawa et al.
6,394,970 B1 5/2002 Maier
6,491,652 B1 12/2002 Hata et al.
6,494,850 B1 12/2002 Kitadou et al.
6,511,446 B1 1/2003 Wu
6,511,448 B1 1/2003 Furuie et al.
6,540,701 B1 4/2003 Inada
6,599,261 B1 7/2003 Chen
6,629,939 B2 10/2003 Jikiba et al.
6,656,140 B2 12/2003 Oguma et al.
6,695,799 B2 2/2004 Kitadou et al.
6,749,577 B2 6/2004 Kume et al.
6,840,914 B1 1/2005 Takamura
6,899,687 B2 5/2005 Hori et al.
6,969,361 B2 11/2005 Hsieh
6,991,609 B2 1/2006 Kan et al.
7,081,099 B1 7/2006 Luo
7,195,604 B2 3/2007 Nakamura et al.
7,549,966 B2 6/2009 Fujii et al.
7,717,868 B2 5/2010 Inada et al.
7,744,548 B2 6/2010 Chen
7,789,466 B2 9/2010 Yoda et al.
7,806,840 B2 10/2010 Chen
7,828,756 B2 11/2010 Kamba et al.
7,854,710 B2 12/2010 Liang
7,947,002 B2 5/2011 Mizoguchi et al.
9,173,804 B2 11/2015 Ishikawa et al.
9,549,867 B1 1/2017 El-Messeiry et al.
2002/0068887 A1 6/2002 Kikumoto et al.
2002/0106282 A1 8/2002 Sharp et al.
2002/0138023 A1 9/2002 Kume et al.
2002/0193713 A1 12/2002 Lee
2004/0097854 A1 * 5/2004 Hester ..... A61H 23/04 601/149
2004/0122343 A1 6/2004 Mori et al.
2004/0158181 A1 8/2004 Watanabe et al.
2005/0010144 A1 1/2005 Chen
2005/0031458 A1 * 2/2005 Brashears ..... B25H 3/006 417/234
2005/0088028 A1 4/2005 Wan et al.
2005/0090769 A1 4/2005 Chen
2005/0101892 A1 * 5/2005 Dehli ..... A61H 9/0078 601/148
2005/0113723 A1 5/2005 Ueyama et al.
2005/0146176 A1 7/2005 Yoda et al.
2005/0192520 A1 9/2005 Morita et al.
2005/0242635 A1 11/2005 Cassaday
2006/0069325 A1 3/2006 Inada et al.
2006/0111653 A1 5/2006 Nishio et al.
2006/0142676 A1 6/2006 Fuji et al.
2006/0217641 A1 9/2006 Tanizawa et al.
2006/0217643 A1 9/2006 Yonekawa et al.
2006/0241536 A1 10/2006 Yoda et al.
2007/0010767 A1 1/2007 Hsieh
2007/0016119 A1 1/2007 Inada et al.
2007/0106185 A1 5/2007 Ferber et al.
2007/0225624 A1 9/2007 Tsukada et al.
2007/0239089 A1 10/2007 Chiu
2007/0287941 A1 12/2007 Yoda et al.
2007/0299377 A1 12/2007 Shiraishi
2008/0009777 A1 1/2008 Chiu
2008/0097260 A1 4/2008 Tsukada et al.
2008/0183112 A1 7/2008 Takebe
2008/0243040 A1 * 10/2008 Kuwabara ..... A61H 1/00 601/149
2009/0036809 A1 * 2/2009 Nishio ..... A61H 9/0078 601/134
2009/0177128 A1 7/2009 Fukuyama et al.
2009/0260639 A1 10/2009 Hsu et al.
2009/0306555 A1 12/2009 Goto
2009/0306558 A1 12/2009 Chen
2010/0030121 A1 2/2010 Fu
2010/0198120 A1 * 8/2010 Tago ..... A61H 1/0237 601/134
2010/0198121 A1 8/2010 Tago et al.
2010/0249613 A1 9/2010 Hashimoto
2010/0312155 A1 12/2010 Fukuyama et al.
2010/0318004 A1 12/2010 Numata et al.
2011/0015554 A1 1/2011 Morikawa et al.
2011/0055720 A1 3/2011 Potter et al.
2011/0077561 A1 3/2011 Choly
2011/0082400 A1 4/2011 Wu
2011/0213503 A1 * 9/2011 Porter, III ..... A61G 5/1043 700/282
2012/0071799 A1 3/2012 Inada et al.
2012/0095375 A1 4/2012 Ishiguro et al.
2012/0157899 A1 6/2012 Terada et al.
2012/0212018 A1 8/2012 Ishikawa et al.
2012/0215143 A1 8/2012 Inada et al.
2013/0088059 A1 4/2013 Nagamitsu
2014/0343467 A1 11/2014 Fukuyama et al.
2015/0051526 A1 2/2015 Wang et al.
2015/0141887 A1 5/2015 Kawashima et al.
2015/0157528 A1 * 6/2015 Le ..... A61H 15/00 601/99
2015/0169124 A1 6/2015 Le et al.
2015/0313790 A1 11/2015 Inada et al.
2015/0351997 A1 * 12/2015 Le ..... A61H 9/0078 601/150
2015/0366746 A1 12/2015 Ashby
2016/0106620 A1 4/2016 Uno et al.
2016/0229320 A1 8/2016 Lem et al.
2016/0282040 A1 9/2016 Wenji et al.
2017/0056280 A1 3/2017 Ode
2017/0290739 A1 10/2017 Shin et al.
2017/0293281 A1 10/2017 Li et al.

FOREIGN PATENT DOCUMENTS

CN 101396322 4/2009
CN 101744707 B 10/2011
EP 1230904 A2 8/2002
EP 1210927 B1 1/2005
JP 2551492 1/1994
JP H06209 A 1/1994
JP H1119150 A 1/1999
JP 11299570 11/1999
JP 2000342644 12/2000
JP 2001095867 4/2001
JP 2001309833 11/2001
JP 2002238963 8/2002
JP 2002240598 8/2002
JP 2004216120 8/2004
JP WO2009013870 1/2009
KR 200276429 5/2002
KR 200438559 2/2008

(56) References Cited

FOREIGN PATENT DOCUMENTS

| | | |
|---|---|---|
| KR | 101458685 | 11/2014 |
| KR | 101515586 | 4/2015 |
| WO | WO2012077842 | 6/2012 |

OTHER PUBLICATIONS

"How Massage Chairs Work," downloaded Sep. 12, 2013, <URL:http://electronics.howstuffworks.com/gadgets/home/massage-chair1.htm>.
"Osaki OS-4000 Instruction Manual," downloaded Sep. 12, 2013, <URL:http://www.hitechmassagechairs.com/PDF/OS-4000-Manual.pdf>.
"Luminous-spa-pedicure-chair-owner-manual," downloaded Aug. 15, 2016, <URL:http://uspedicurespa.com/resources/lexor/luminous-spa-pedicure-chair-owner-manual.pdf >.

* cited by examiner

MASSAGE CHAIR HAVING A NOISE-REDUCING, ENCLOSURE DEVICE

BACKGROUND OF THE INVENTION

Field of the Invention

The present invention generally relates to massage chairs, massage devices and apparatuses for massage chairs, and noise-reducing devices and systems. More specifically, the present invention is directed to a massage chair having a noise-reducing, enclosure device.

Description of the Related Art

Massage chairs, massage devices and apparatuses for massage chairs, and noise-reducing devices and systems are known in the art.

In many current massage systems and devices related to massage chairs, the massage system or device usually has an air compressor to pump air into the air cells or bags throughout the massage chair to provide massage effects to users of the massage chair at air massage pressure points. Due to the electro-mechanical movement to generate the compressed air, the air compressor can make a very unpleasant noise when it operates. In addition, the air valves' operation to control the air flow into and out of air cells are also noisy. Thus, a massage chair having a noise-reducing, device or system is desired for reducing noise generated from and/or made by these devices so as to make the massage environment more quiet and relaxing for users of the massage chair.

The present invention overcomes one or more of the shortcomings of massage chairs, massage devices and apparatuses for massage chairs, and noise-reducing devices and systems. The Applicant is unaware of inventions or patents, taken either singly or in combination, which are seen to describe the present invention as claimed.

SUMMARY OF THE INVENTION

The present invention is directed to a massage chair having a massage chair frame, a massage system that includes a plurality of fluid massage elements, and a noise-reducing (or noise-absorbing, noise-containing or noise-cancelling), enclosure device.

The massage chair frame includes a first end, a second end, a seat or bottom body area portion, and a back body area portion extending upward from the seat or bottom body area portion toward the second end. Preferably, the massage chair frame also includes a thigh body area portion located between the seat or bottom body area portion and the first end, a head and neck body area portion extending upward from the back body area portion and located about the second end, and a lower leg body area portion located downward (or extending downward) from the thigh body area portion and located about the first end.

The massage system comprises at least one fluid massage element, a fluid compressor or pump, and at least one fluid valve device for regulating fluid flow into and out of the at least one fluid massage element. Preferably, the massage system also comprises at least one fluid transport device and a power source. Also preferably, the at least one fluid massage element is a plurality of fluid massage elements, the at least one fluid valve device is a plurality of fluid valve devices, and the at least one fluid transport device is a plurality of fluid transport devices. The massage system is in operational communication with the massage chair frame such that the massage system provides massaging effects to a user positioned in the massage chair.

Each of the plurality of fluid massage elements is adapted for having fluid transported or pumped into it by the fluid compressor or pump and for having fluid withdrawn from it. The plurality of fluid massage elements may be positioned at predetermined massage locations on, about, or in the vicinity of the massage chair frame and/or may be moved or transported to desired massage locations by the user.

The fluid compressor or pump pumps fluid into the plurality of fluid massage elements such that massaging effects can be provided to the user at desired massage locations or pressure points.

The plurality of fluid valve devices regulate fluid flow into and out of the plurality of fluid massage elements.

The plurality of fluid transport devices transport fluid flow into and out of the plurality of fluid massage elements.

The power source provides power to the fluid compressor or pump, and may also be used to provide power to other components of the massage chair.

The noise-reducing (or noise-absorbing, noise-containing, or noise-cancelling), enclosure device comprises an enclosure housing and noise-reducing (or noise-absorbing, noise-containing, or noise-cancelling) material positioned inside the enclosure housing. The enclosure housing encloses the fluid compressor or pump and the plurality of fluid valve devices during operation. The noise-reducing, enclosure device is preferably positioned in proximity of the massage chair frame.

The enclosure housing encloses the fluid compressor or pump and the plurality of fluid valve devices during operation such that noise generated from or made by the fluid compressor or pump and the plurality of fluid valve devices during operation is reduced, contained or eliminated.

Preferably, the noise-reducing (or noise-absorbing, noise-containing, or noise-cancelling) material is positioned inside the enclosure housing in such a way that it surrounds the fluid compressor or pump and the plurality of fluid valve devices such that noise generated from or made by the fluid compressor or pump and the plurality of fluid valve devices during operation is reduced, contained or eliminated.

Figure 1:
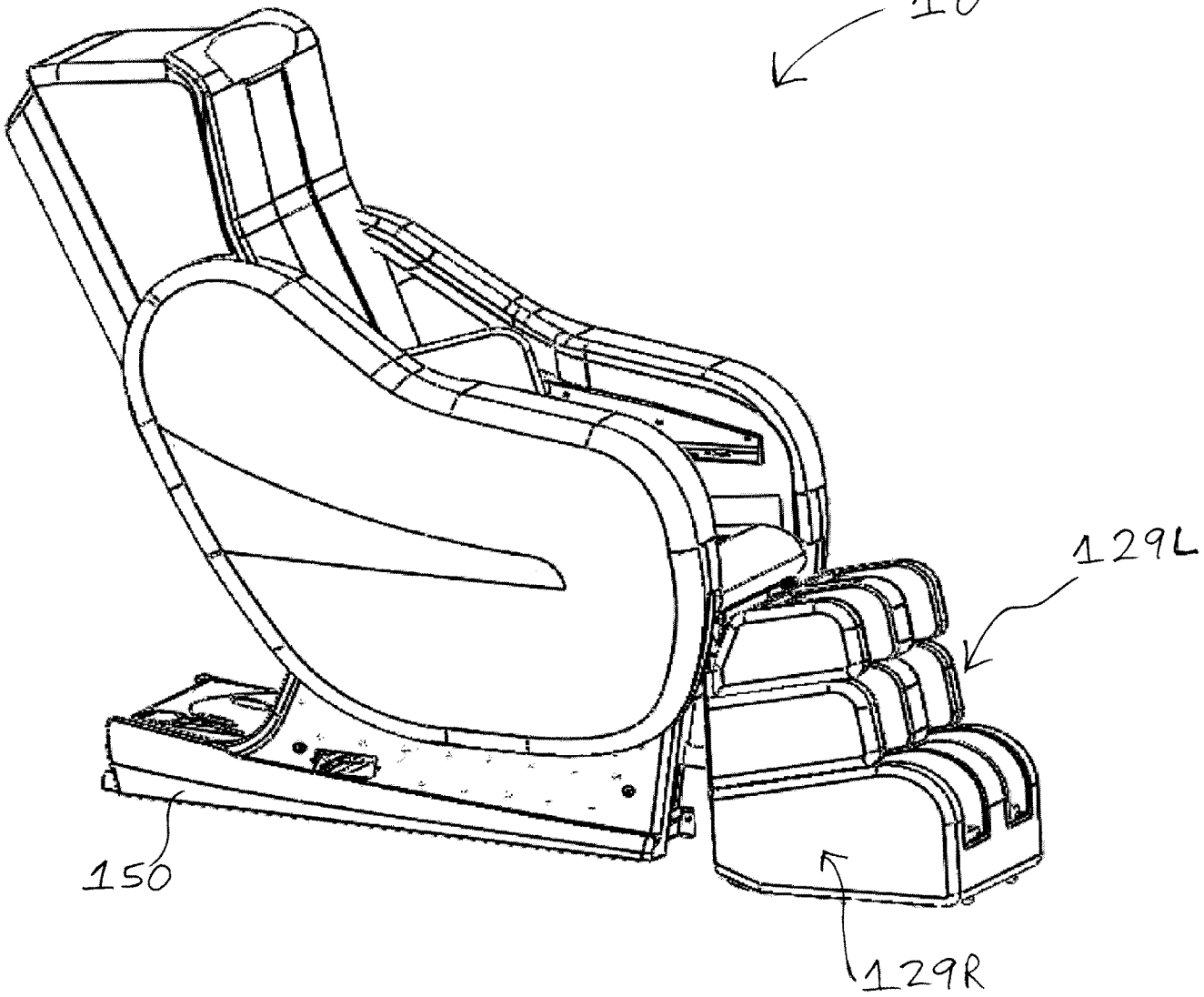
FIG. 1 is a right side, perspective view of a massage chair according to the present invention.

It should be understood that the above-attached figures are not intended to limit the scope of the present invention in any way.

DETAILED DESCRIPTION OF THE PREFERRED EMBODIMENTS

Referring to FIGS. 1-14, the present invention is directed to a massage chair 10 having a massage chair frame 110, a massage system 170 that includes a plurality of fluid massage elements 180, and a noise-reducing (or noise-absorbing, noise-containing or noise-cancelling), enclosure device 230.

The massage chair frame 110 includes a first end, a second end, a seat or bottom body area portion, and a back body area portion extending upward from the seat or bottom body area portion toward the second end. Preferably, the massage chair frame 110 also includes a thigh body area portion located between the seat or bottom body area portion and the first end, a head and neck body area portion extending upward from the back body area portion and located about the second end, and a lower leg body area portion located downward (or extending downward) from the thigh body area portion and located about the first end. In general, the massage chair frame 110 may be any massage chair frame known to one of ordinary skill in the art that comprises at least a seat or bottom body area portion and a back body area portion.

Figure 2:
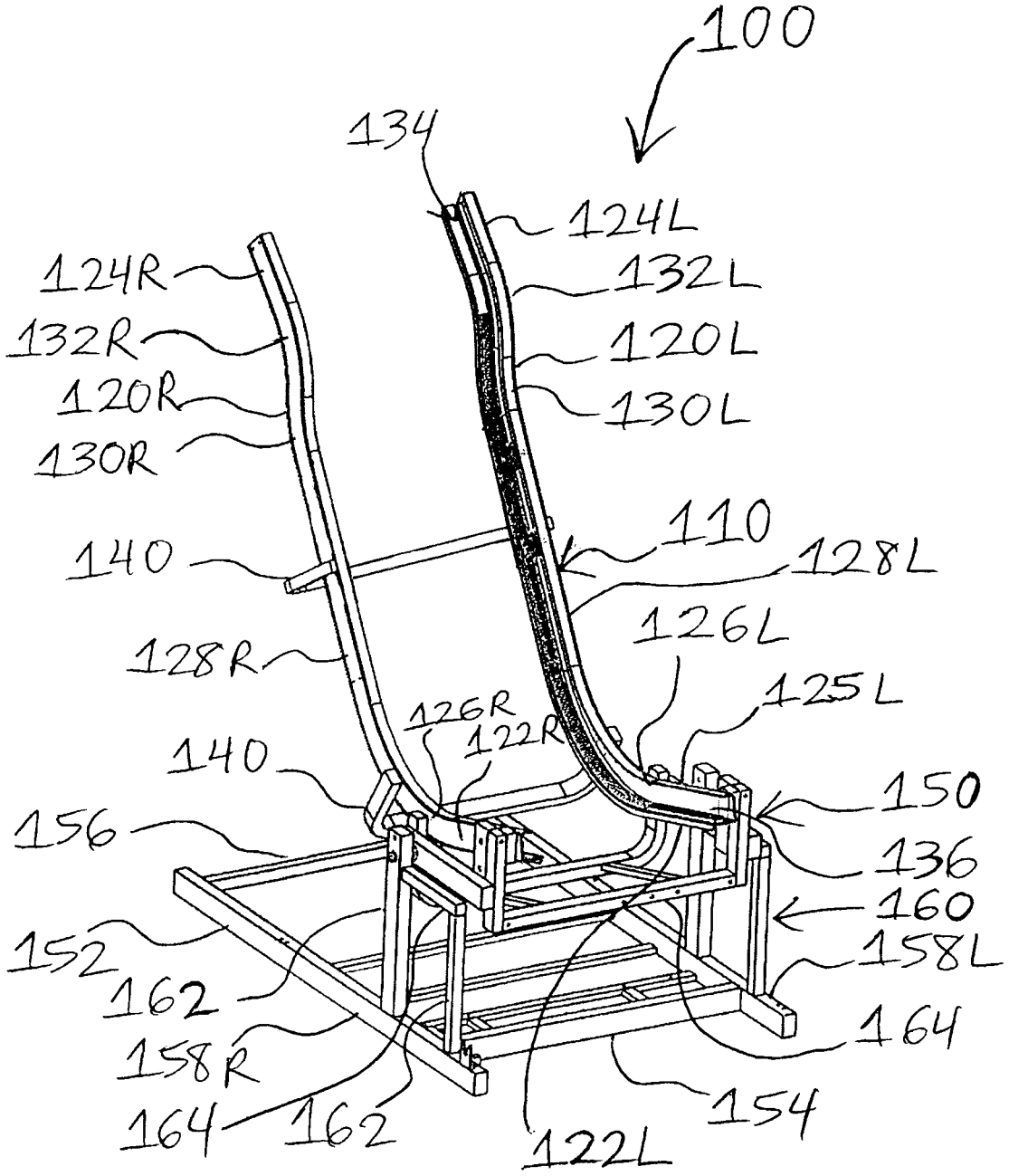
FIG. 2 is a perspective view of a massage chair frame for a massage chair according to the present invention.
Figure 3:
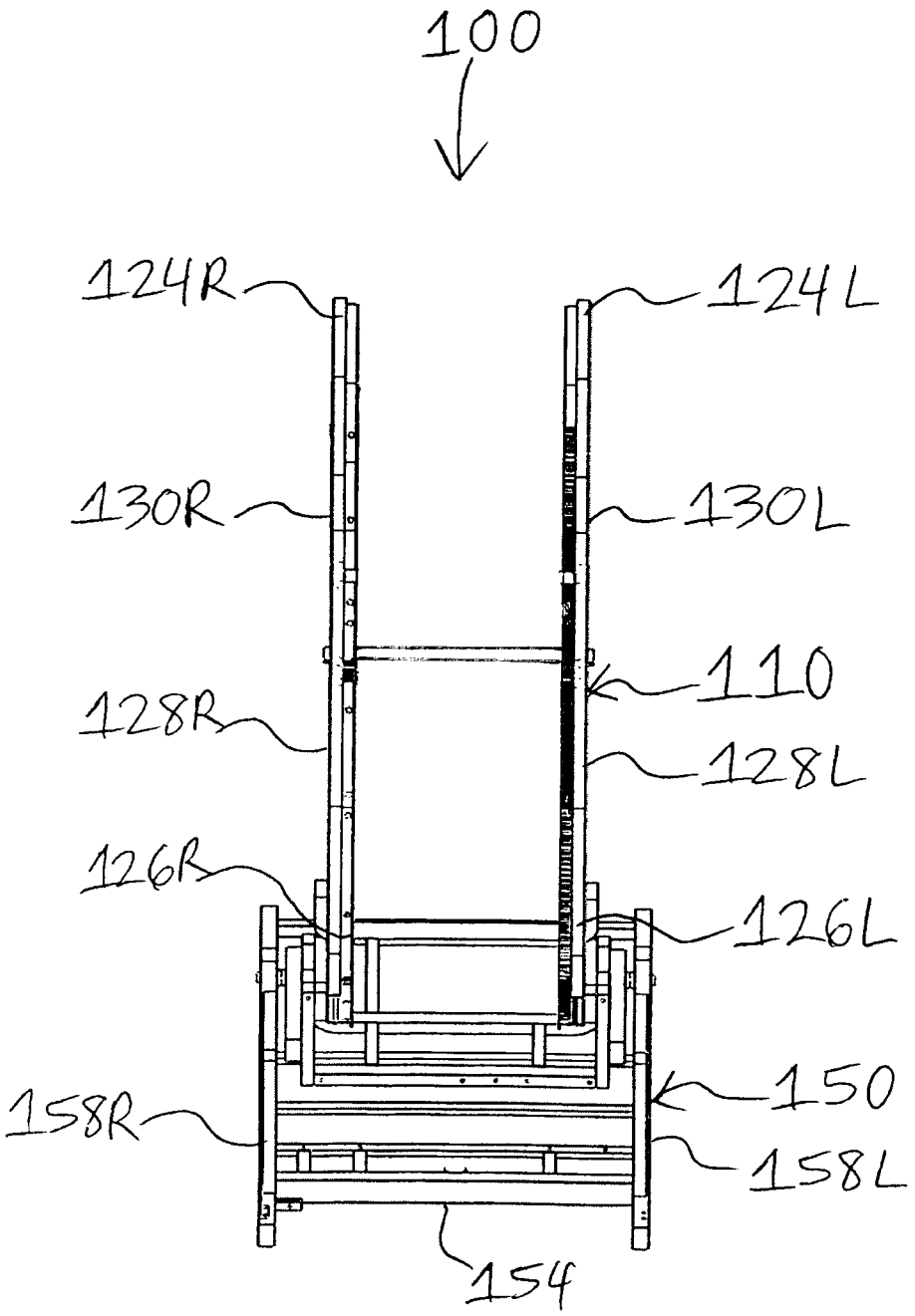
FIG. 3 is a front view of the massage chair frame of FIG. 2.
Figure 4:
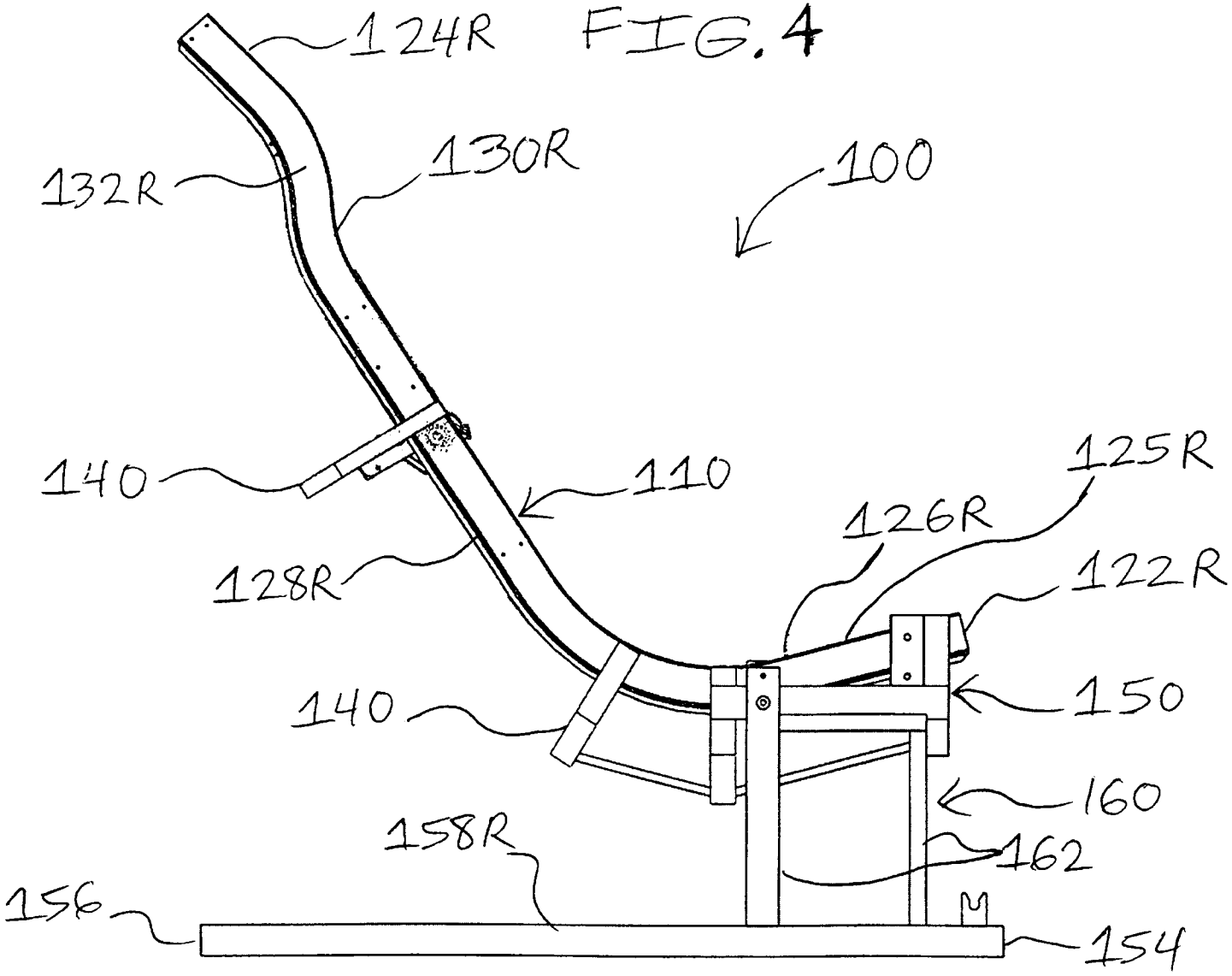
FIG. 4 is a right side view of the massage chair frame of FIG. 2.
Figure 5:
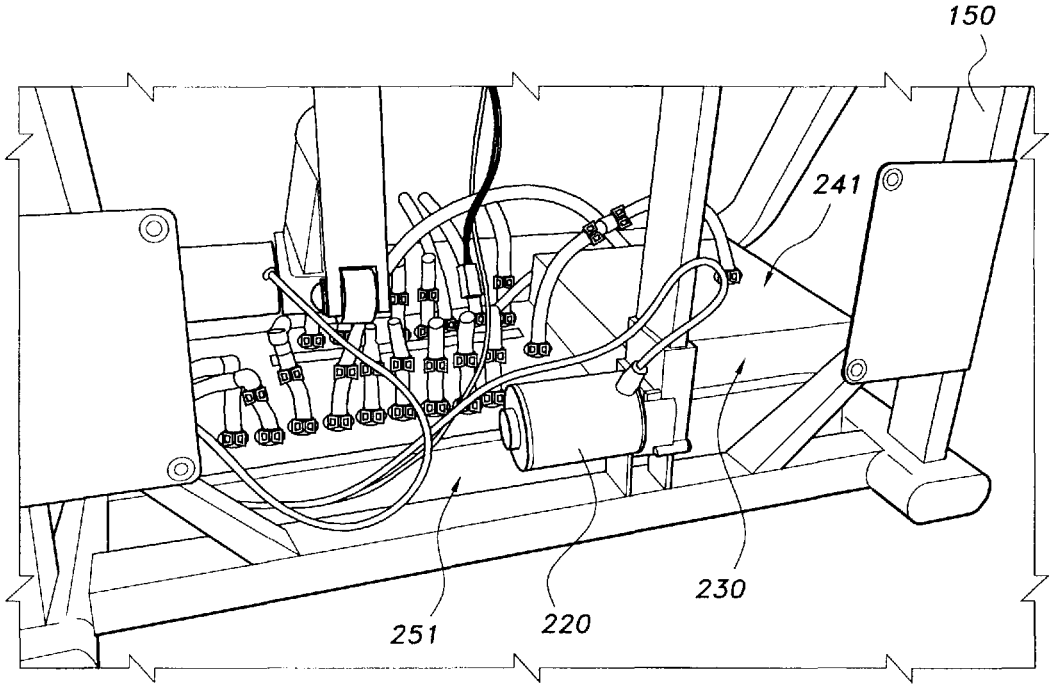
FIG. 5 is a rear, perspective view of a massage chair frame and a massage system of a massage chair according to the present invention.
Figure 6:
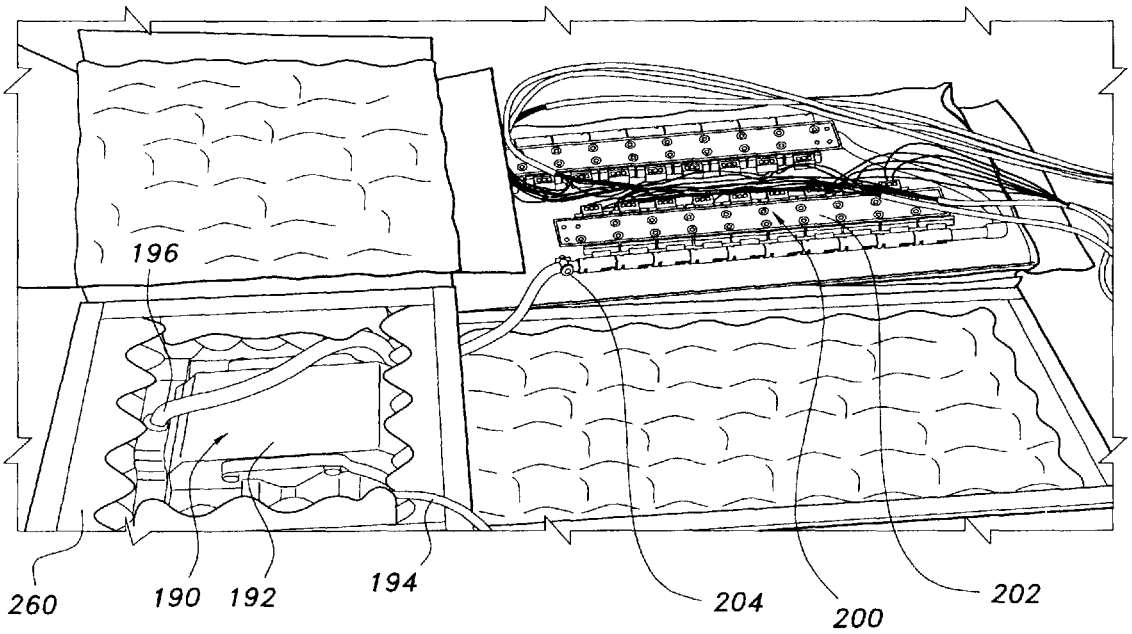
FIG. 6 is a top, perspective view of a massage system and a noise-reducing, enclosure device of a massage chair according to the present invention.
Figure 7:
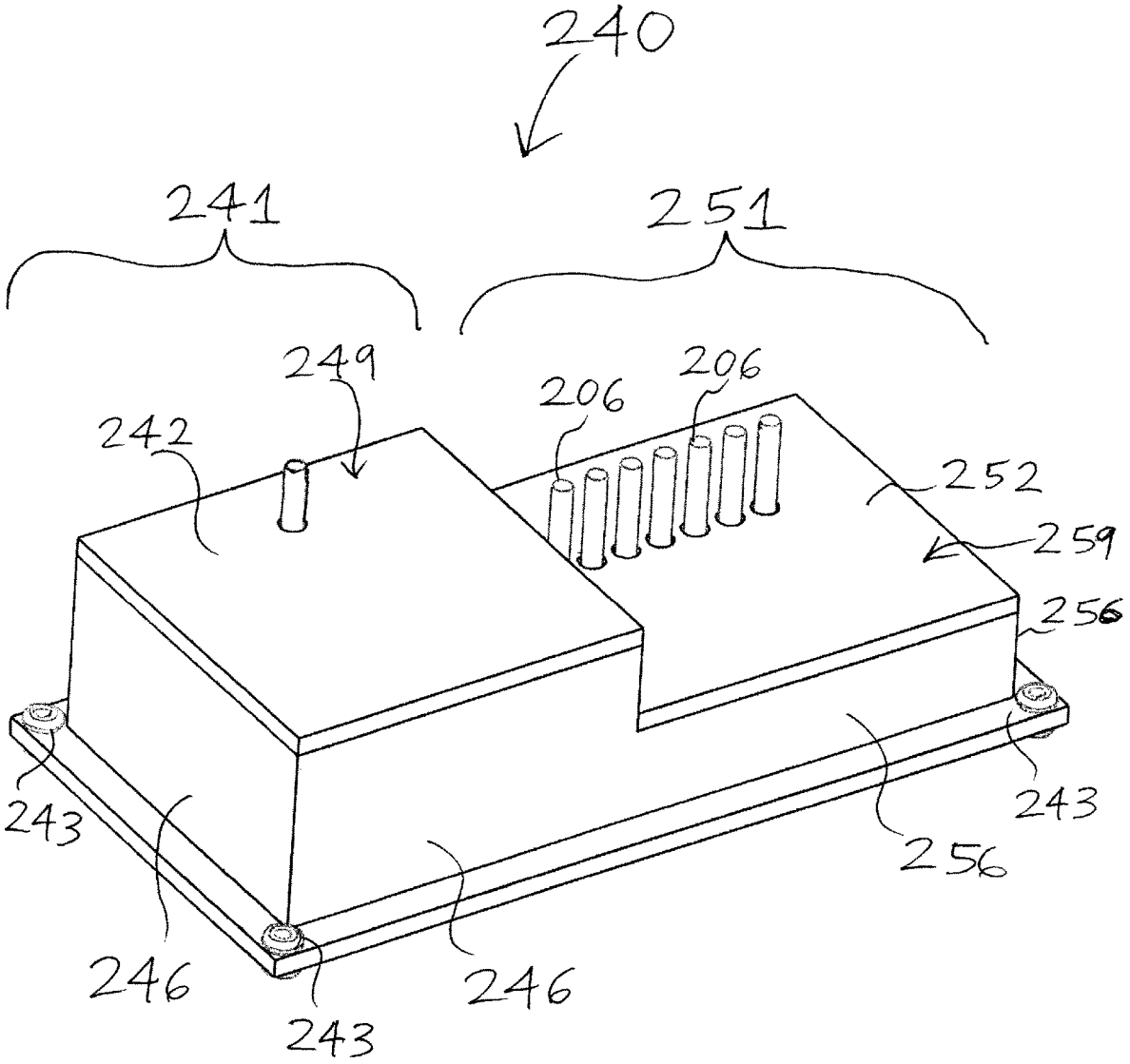
FIG. 7 is a top, perspective view of the noise-reducing, enclosure device of FIG. 6.
Figure 8:
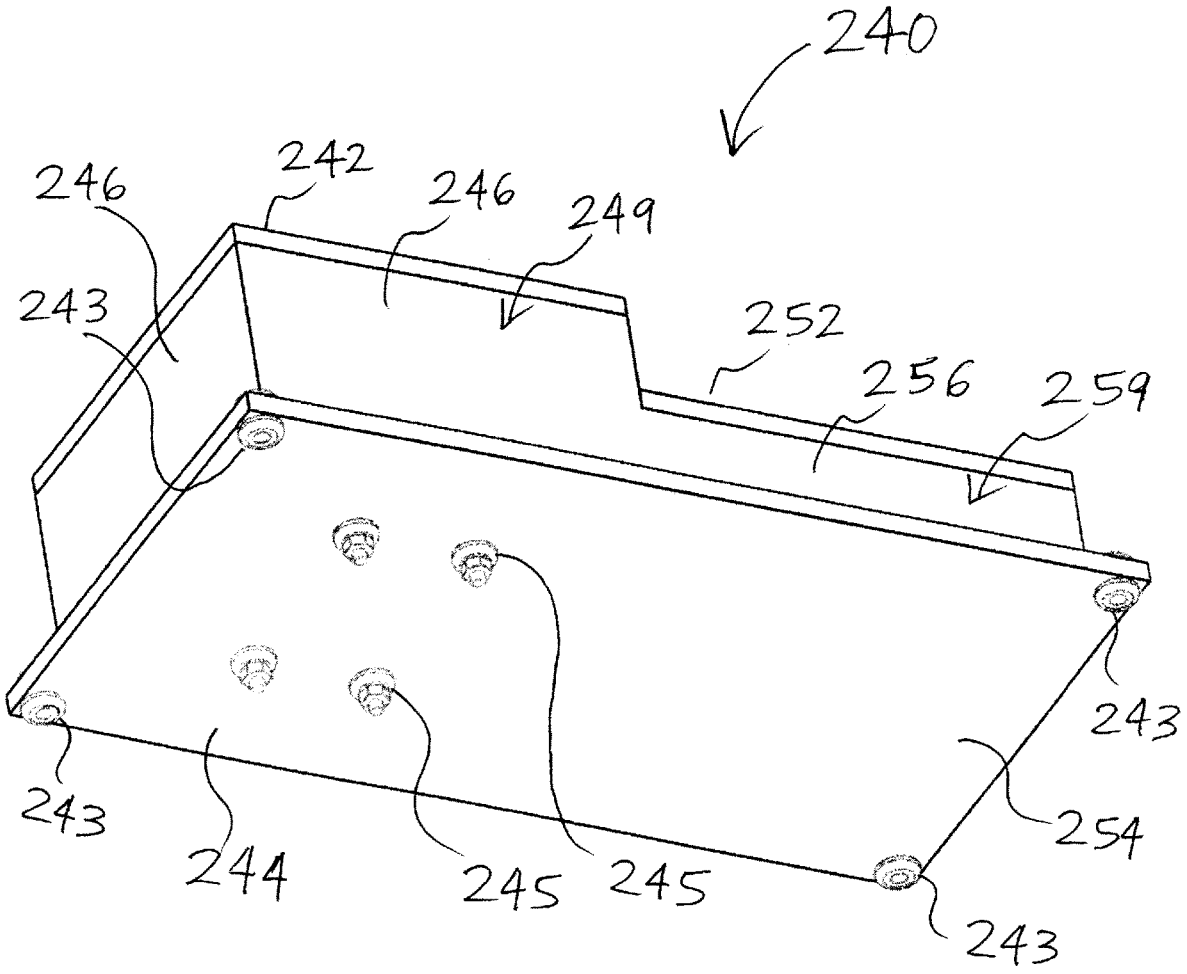
FIG. 8 is a bottom, perspective view of the noise-reducing, enclosure device of FIG. 6.
Figure 9:
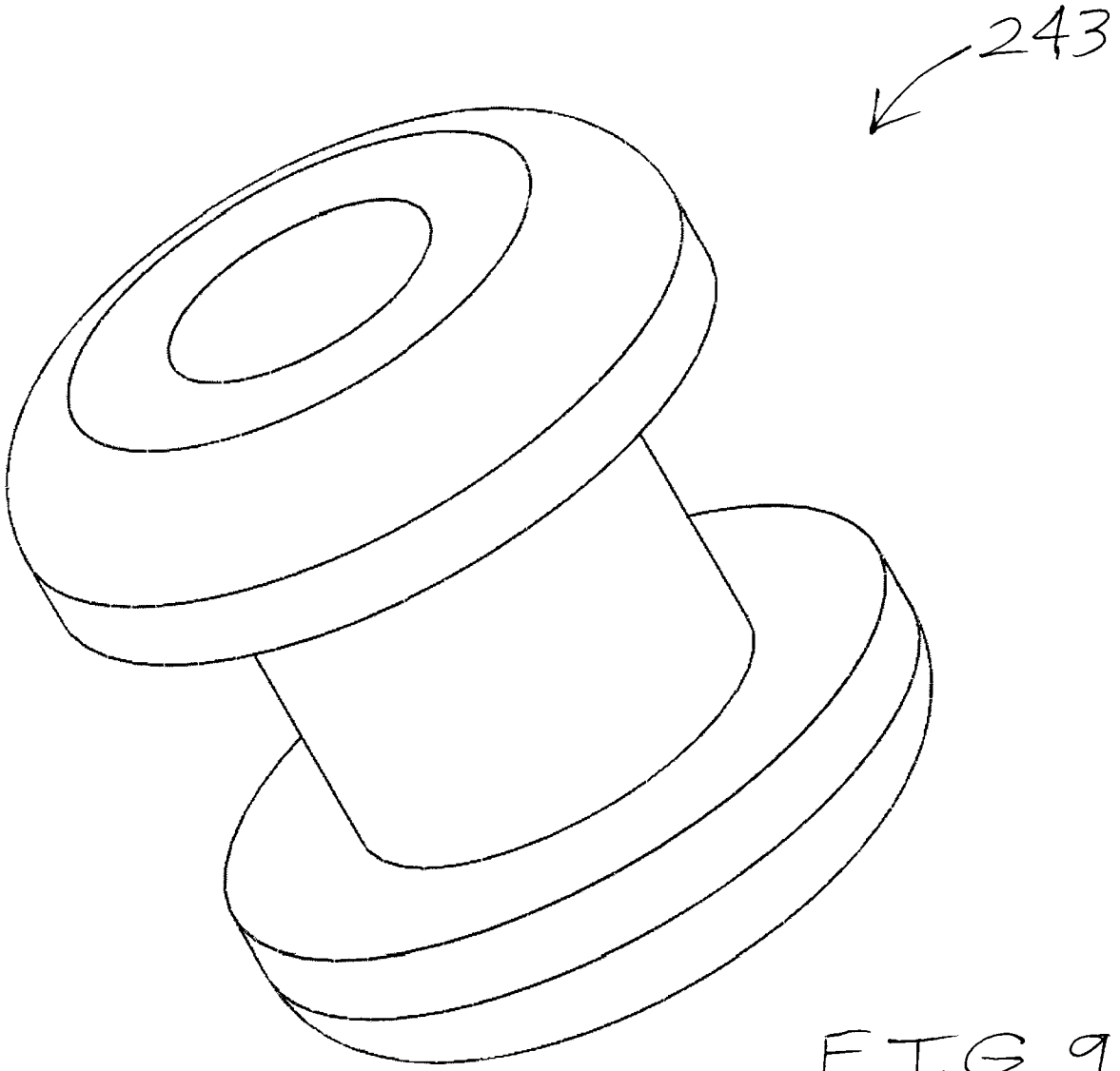
FIG. 9 is a perspective view of a foot element the noise-reducing, enclosure device of FIG. 6.

As a non-limiting example and as best shown in FIGS. 2-4, the massage chair frame 110 includes a pair of opposing guide rails 120R,120L, a plurality of guide rails stabilizing bars 140, and a base stand 150. The guide rails 120R,120L are secured to the base stand 150, and are positioned generally above the base stand 150. The base stand 150 supports the weights of the guide rails 120R,120L and, preferably, also the weight of a user (not shown) of the massage chair.

Preferably, the guide rails 120R,120L are substantially similar or mirror images of one another. Each of the guide rails 120R,120L includes a first end 122R,122L, a second end 124R,124L, a thigh body area portion 125R,125L located adjacent the first end 122R,122L, a seat or bottom body area portion 126R,126L located adjacent the thigh body area portion 125R,125L and away from the first end 122R,122L, a back body area portion 128R,128L extending upward from the bottom body area portion 126R,126L, a head and neck body area portion 130R,130L extending upward from the back body area portion 128R,128L and located about the second end 124R,124L, an outer side 132R,132L, an inner side 134, and a guide channel 136 extending from the thigh body area portion 125R,125L to the back body area portion 128R,128L, preferably to the head and neck body area portion 130R,130L, and running along the inner side 134 of the guide rail 120R,120L. The guide channel 136 may include gear teeth 138 for engaging with at least one gear member from a mechanical massage device (not shown) when the mechanical massage device moves upward and downward in a generally vertical direction from the first end 122R,122L toward the second end 124R,124L of the guide rail 120R,120L and vice versa, respectively. Preferably, each of the guide rails 120R,120L has a generally "L-shaped" configuration. In this configuration, the lower portion of the "L" includes the thigh body area portion 125R,125L and bottom body area portion 126R,126L, and the upper portion of the "L" includes the back body area portion 128R,128L and head and neck body area portion 130R,130L. As best shown in FIGS. 1 and 3, more preferably, each of the guide rails 120R,120L has a reclining "L-shaped" configuration.

Preferably, as shown in FIG. 1, the lower leg body area portion 129R,129L is a further extension of the massage chair frame 110, or is an add-on device that is secured or attached about the first end 122R,122L of the guide rails 120R,120L of the massage chair frame 110. Preferably, the lower leg body area portion 129R,129L is located downward (or extending downward) from the thigh body area portion 125R,125L and located downward (or extending downward) from the first end 122R,122L.

The plurality of guide rails stabilizing bars 140 help to stabilize the positioning of the guide rails 120R,120L relative to one another. Each of the guide rails stabilizing bars 140 has a first end 142, a second end 144, and a body portion 146 extending from the first end 142 to the second end 144. Preferably, each of the guide rails stabilizing bars 140 has a generally "U-shaped" configuration. The guide rails stabilizing bars 140 are secured at predetermined locations along the outer sides 132R,132L of the guide rails 120R,120L.

The base stand 150 includes a base 152 and a guide rails support structure 160. The base 152 includes a first or front end 154, a second or rear end 156, and a pair of opposing sides 158R,158L. The guide rails support structure 160 is secured about the front end 154 of the base 152, and is positioned above the base 152. The guide rails support structure 160 includes a plurality of vertical bars or members 162 and a plurality of horizontal bars or members 164. The plurality of vertical bars 162 extend upward from the pair of opposing sides 158R,158L of the base 152, and, along with the plurality of horizontal bars 164, form a support frame with a "square-shaped" or "rectangular-shaped" box configuration.

Since the base stand 150 supports the weights of the guide rails 120R,120L and user of the massage chair, the base stand 150 is preferably made or manufactured of a strong material, such as, but not limited to, steel, metal, wood, hard plastic, any material or combination of materials known to one of ordinary skill in the art, and any combination thereof. Also, each of the guide rails 120R,120L and plurality of guide rails stabilizing bars 140 may be made or manufactured of steel, metal, wood, plastic, any material or combination of materials known to one of ordinary skill in the art, and any combination thereof.

As best shown in FIGS. 5, 6 and 14-15, the massage system 170 comprises at least one fluid massage element 180, a fluid compressor or pump 190, and at least one fluid valve device 200 for regulating fluid flow into and out of the at least one fluid massage element 180. Preferably, the massage system 170 also comprises at least one fluid transport device 210 and a power source 220. Also preferably, the at least one fluid massage element 180 is a plurality of fluid massage elements 180, the at least one fluid valve device 200 is a plurality of fluid valve devices 200, and the at least one fluid transport device 210 is a plurality of fluid transport devices 210. The massage system 170 is in operational communication with the massage chair frame 110 such that the massage system 170 provides massaging effects to a user (not shown) positioned in the massage chair 10.

Each of the plurality of fluid massage elements 180 is adapted for having fluid transported or pumped into it by the fluid compressor or pump 190 and for having fluid withdrawn from it. The plurality of fluid massage elements 180 may be positioned at predetermined massage locations on, about, or in the vicinity of the massage chair frame 110 and/or may be moved or transported to desired massage locations by the user. The plurality of fluid massage elements 180 may be a plurality of fluid massage cells (such as, but not limited to, air cell 180 shown in FIGS. 13A and 13B), a plurality of fluid massage bags (such as, but not limited to, air bags), any fluid massage element(s) known to one of ordinary skill in the art, and any combination thereof. The air cell 180 comprises an inflatable or expandable air cell housing 182, an air cell chamber 184 defined by the air cell housing 182, and an air cell inlet and outlet 186. The fluid that is contained in and/or pumped into and out of the plurality of fluid massage elements 180 may be air, a liquid, a gel, any fluid(s) known to one of ordinary skill in the art, and any combination thereof.

The fluid compressor or pump 190 pumps fluid into the plurality of fluid massage elements 180 such that massaging effects can be provided to the user at desired massage locations or pressure points. The fluid compressor or pump 190 comprises a fluid pump body 192, a fluid pump inlet 194, and a fluid pump outlet 196. The fluid compressor or pump 190 (such as the non-limiting example shown in FIGS. 6, 10 and 11) may be any fluid compressor or pump known to one of ordinary skill in the art that is able to pump air, a liquid, a gel, any fluid(s) known to one of ordinary skill in the art, and any combination thereof into the plurality of fluid massage elements 180.

The plurality of fluid valve devices 200 regulate fluid flow into and out of the plurality of fluid massage elements 180. Each of the fluid valve device 200 comprises a fluid valve body 202, a fluid valve inlet 204, and a fluid valve outlet 206. Each of the plurality of fluid valve devices 200 (such as the non-limiting example shown in FIGS. 6, 10 and 11) may be any fluid valve device known to one of ordinary skill in the art that is able to regulate fluid flow into and out of the corresponding fluid massage element(s) 180.

The plurality of fluid transport devices 210 transport fluid flow into and out of the plurality of fluid massage elements 180. Each of the plurality of fluid transport devices 210 (such as the non-limiting example shown in FIGS. 13A and 13B) may be any fluid transport device known to one of ordinary skill in the art that is able to transport fluid flow into and out of the corresponding fluid massage element(s) 180. The fluid transport device 210 is a transport tube 210 having a tube first end 212, a tube second end 214, and a tube body 216 extending between the tube first end 212 and tube second end 214.

The power source 220 provides power to the fluid compressor or pump 190, and may also be used to provide power to other components of the massage chair 100. The power source 220 may be a battery, a connector or cord for plugging into a power outlet (such as, but not limited to, a detachable DC power supply cord), a plug for receiving power or electricity, any power source known to one of ordinary skill in the art, and any combination thereof.

As best shown in FIGS. 5-12, the noise-reducing (or noise-absorbing, noise-containing, or noise-cancelling), enclosure device 230 comprises an enclosure housing 240 and noise-reducing (or noise-absorbing, noise-containing, or noise-cancelling) material 260 positioned inside the enclosure housing 240. The enclosure housing 240 encloses the fluid compressor or pump 190 and the plurality of fluid valve devices 200 during operation. The noise-reducing, enclosure device 230 is preferably positioned in proximity of the massage chair frame 110. As a non-limiting example shown in FIGS. 1 and 5, the noise-reducing, enclosure device 230 is positioned below the seat or bottom body area portion 126R,126L of the massage chair frame 110.

As a non-limiting example and as best shown in FIGS. 6-11, the enclosure housing 240 has a first section 241 that comprises a top 242, a bottom 244, a plurality of sides 246, an inner surface 248, and an outer surface 249, and a second section 251 that comprises a top 252, a bottom 254, a plurality of sides 256, an inner surface 258, and an outer surface 259. Preferably, the inner surfaces 248, 258 and noise-reducing (or noise-absorbing, noise-containing, or noise-cancelling) material 260 help to form noise-reducing (or noise-absorbing, noise-containing, or noise-cancelling) walls for the enclosure housing 240. The first section 241 of the enclosure housing 240 encloses (partially, substantially, or fully encloses) the fluid compressor or pump 190 while the second section 251 of the enclosure housing 240 encloses (partially, substantially, or fully encloses) the plurality of fluid valve devices 200 such that noise generated from or made by the fluid compressor or pump 190 and the plurality of fluid valve devices 200 during operation is reduced, contained or eliminated. The enclosure housing 240 also has a plurality of foot elements 243 positioned at predetermined locations on the periphery of the enclosure housing 240, and a plurality of screw and nut elements 245 positioned at predetermined locations.

Figure 10:
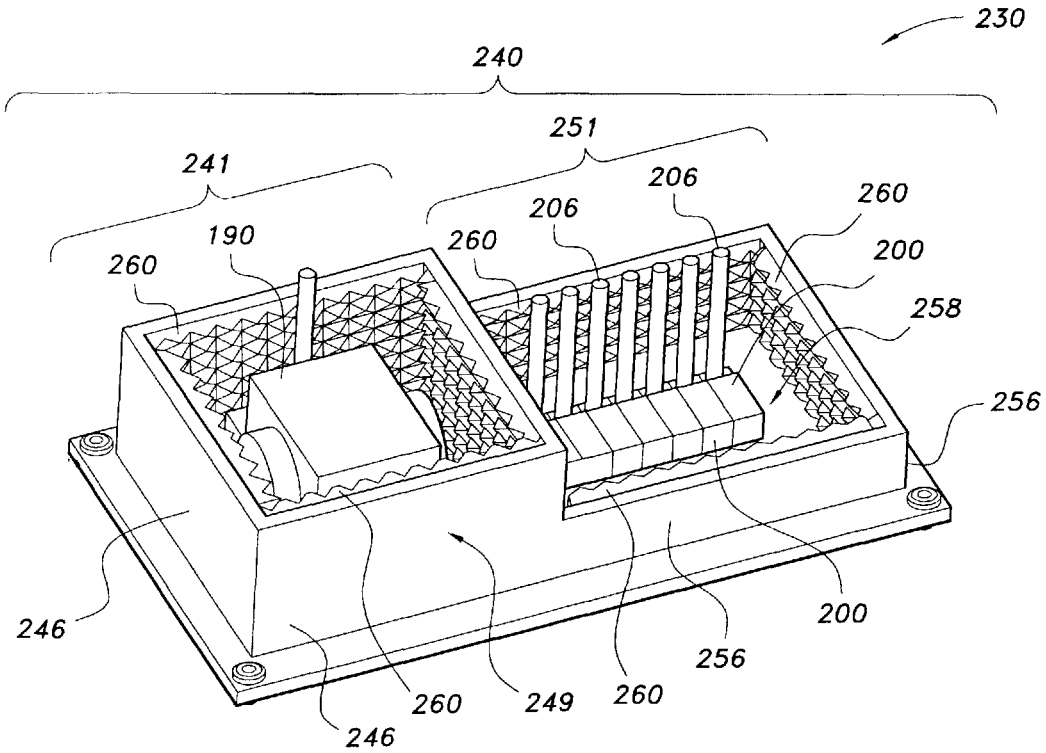
FIG. 10 is a top, perspective view of the massage system and the noise-reducing, enclosure device of FIG. 6, with a top of the noise-reducing, enclosure device being temporarily removed.
Figure 11:
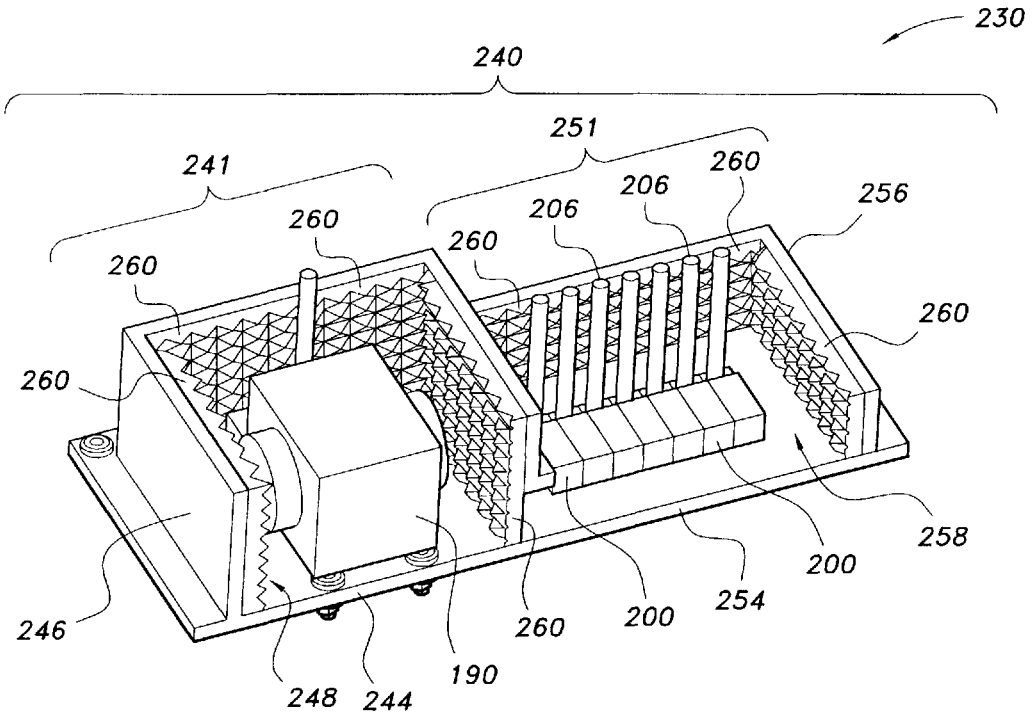
FIG. 11 is a partial cut-away, top, perspective view of the massage system and the noise-reducing, enclosure device of FIG. 6, with a top of the noise-reducing, enclosure device being temporarily removed.
Figure 12:
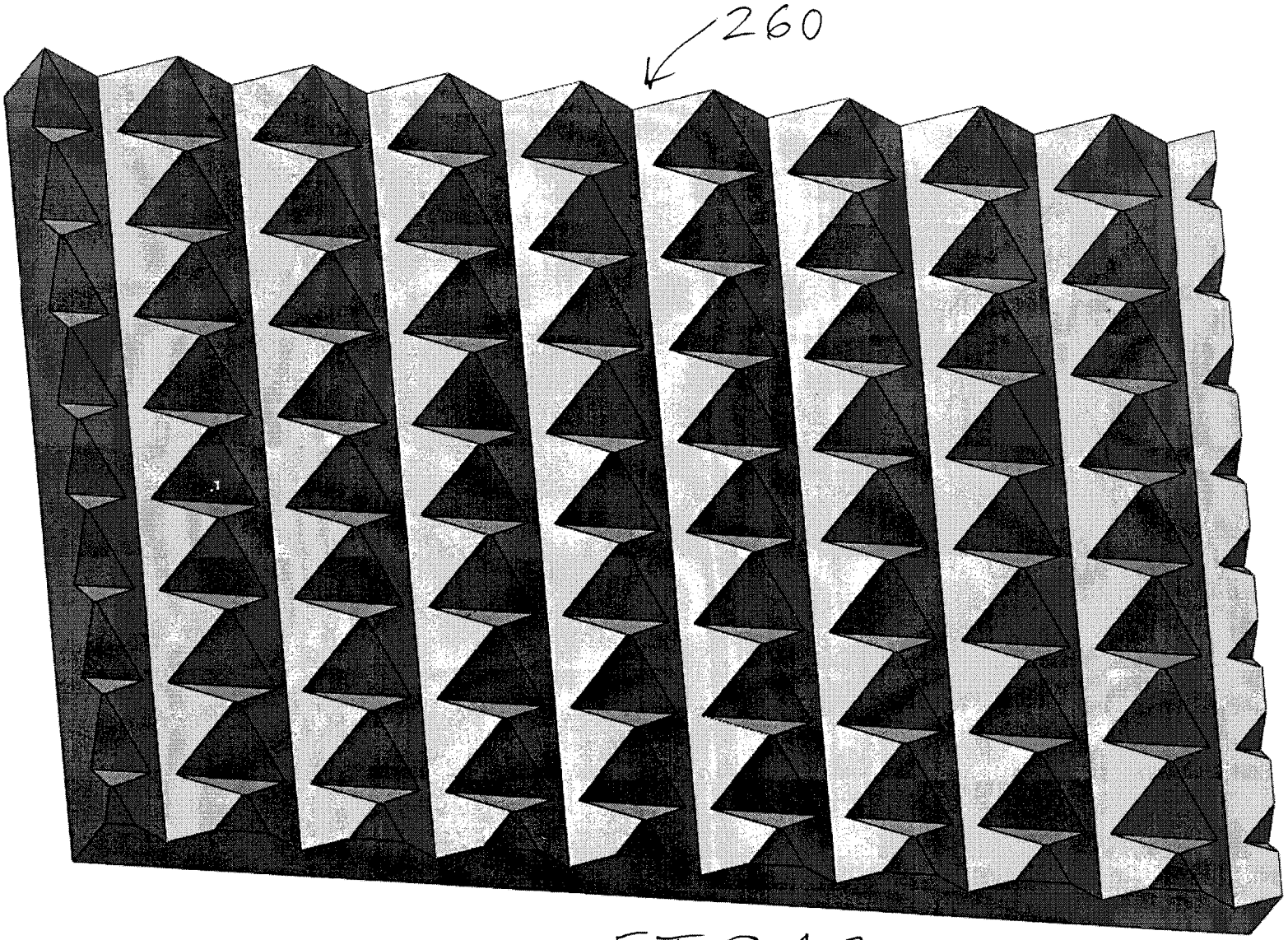
FIG. 12 is a perspective view of noise-reducing material of the noise-reducing, enclosure device of FIG. 6.
Figure 13B:
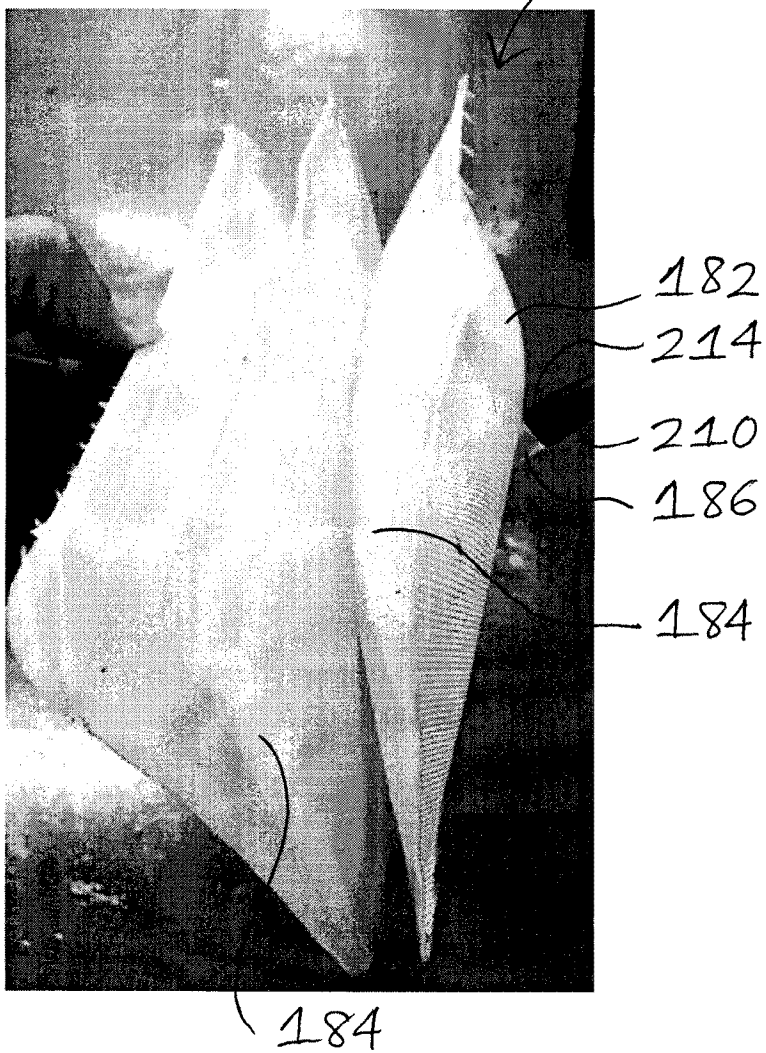
FIG. 13B is a perspective view of the fluid massage element and the fluid transport device of FIG. 13A.
Figure 13A:
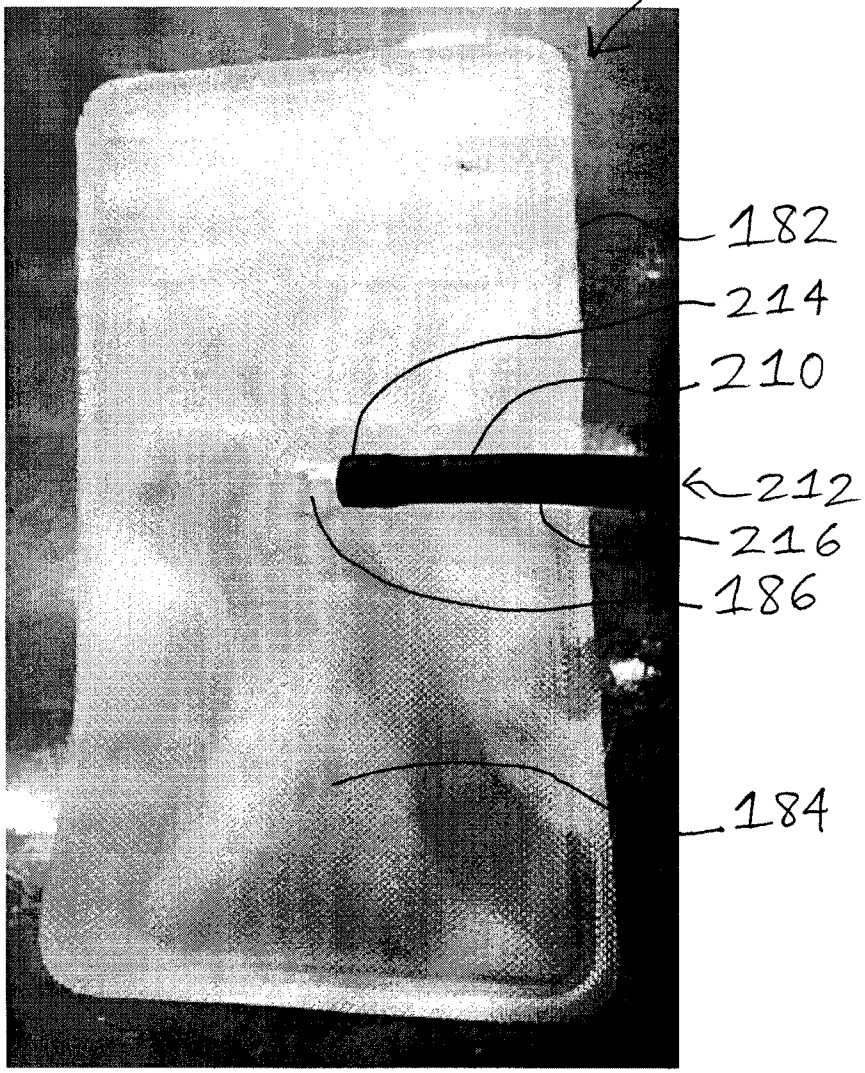
FIG. 13A is a side, perspective view of a fluid massage element and a fluid transport device of a massage system of a massage chair according to the present invention.
Figure 14:
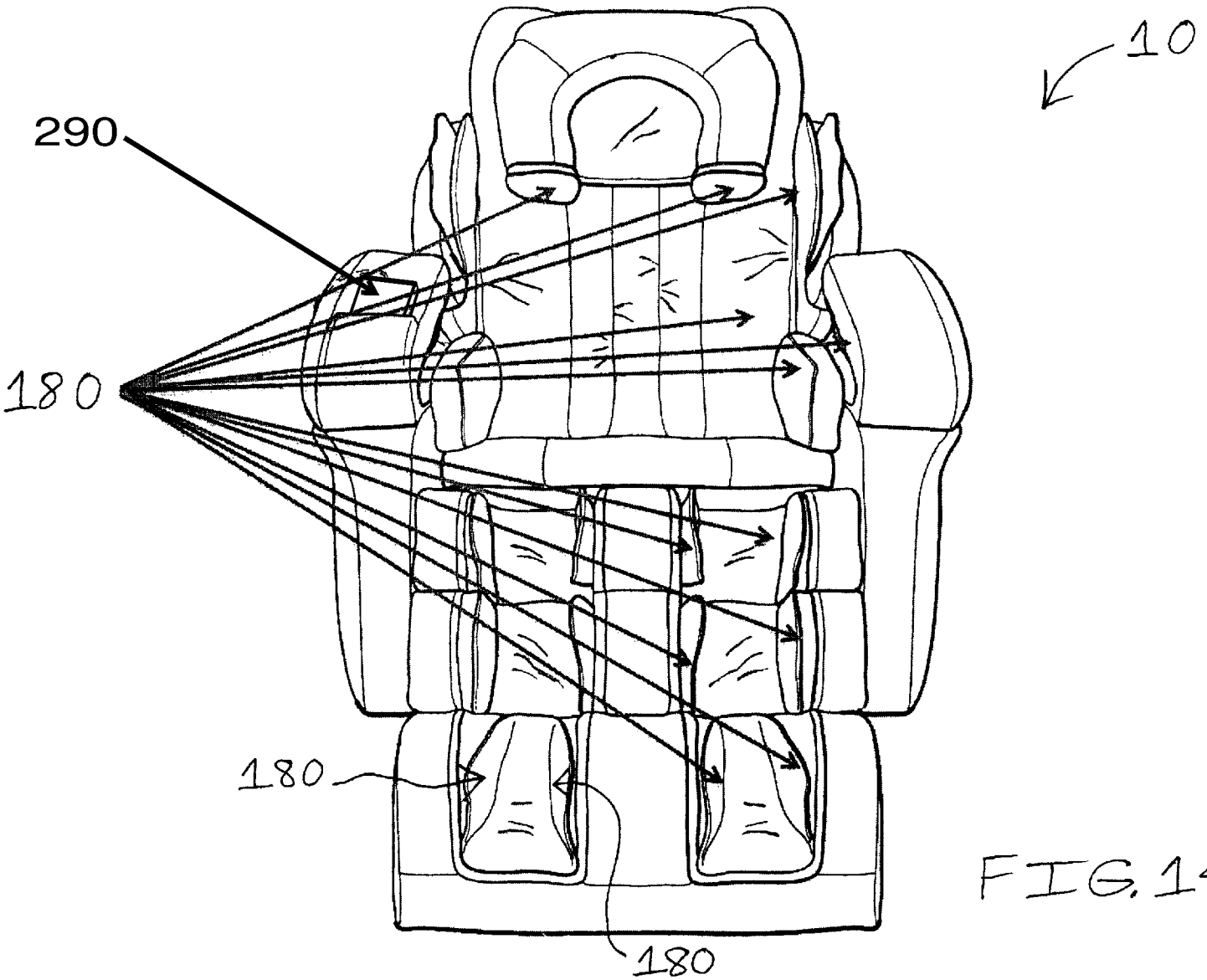
FIG. 14 is an elevated, front view of a massage chair, showing multiple locations where fluid massage elements may be positioned.

Preferably, the noise-reducing (or noise-absorbing, noise-containing, or noise-cancelling) material 260 is positioned inside the enclosure housing 240 in such a way that it surrounds the fluid compressor or pump 190 and the plurality of fluid valve devices 200 such that noise generated from or made by the fluid compressor or pump 190 and the plurality of fluid valve devices 200 during operation is reduced, contained or eliminated. Preferably, as shown in FIGS. 10 and 11, all of the inner surfaces 248,258 of the enclosure housing 240 are covered by the noise-reducing material 260. Preferably, all of the electro-mechanical components positioned inside the enclosure housing 240 are fully surrounded by the noise-reducing material 260. The noise-reducing material 260 may be foam, noise-reducing foam, noise-absorbing foam, noise-containing foam, noise-cancelling foam, any noise-reducing material known to one of ordinary skill in the art, any noise-absorbing material known to one of ordinary skill in the art, any noise-containing material known to one of ordinary skill in the art, any noise-cancelling material known to one of ordinary skill in the art, and any combination thereof.

When in use or in operation, the user (not shown) may activate the massage system 170 of the massage chair 100 by or via pushing, touching, using voice command for use on or with, using a mechanical or remote control 290 for use on or with, or any other activation method known to one of ordinary skill in the art, an activation, start, control or command button, touch area, box or panel, or any other activation method or element known to one of ordinary skill in the art. Preferably, the user is able to control the massage producing-effects of the plurality of fluid massage elements 180 such that the plurality of fluid massage elements 180 provide massage producing-effects to a desired body part area(s), such as the thighs, bottom, lower back, upper back, head and neck, and/or lower leg of the user so that desired body part area(s) of the user can receive massage effects or benefits from the plurality of fluid massage elements 180 when desired.

It is to be understood that the present invention is not limited to the embodiments described above or as shown in the attached figures, but encompasses any and all embodiments within the spirit of the invention.

What is claimed is:

1. A massage chair comprising:

a massage chair frame comprising a first end, a second end, a seat or bottom body area portion, and a back body area portion extending upward from said bottom body area portion toward said second end;

a massage system in operational communication with said massage chair frame such that said massage system is capable of providing massaging effects to a user positioned in said massage chair, wherein said massage system comprises at least one air massage element, an air compressor or pump, and at least one air valve device for regulating air flow into and out of said at least one air massage element; and a noise-reducing, enclosure device comprising an enclosure housing, wherein said enclosure housing comprises a first section and a second section, wherein said first section encloses said at least one compressor or pump while said second section encloses said at least one air valve device, wherein said first section comprises a noise-reducing material surrounding said at least one compressor or pump, and wherein said second section comprises a noise-reducing material surrounding said at least one air valve device.

2. The massage chair according to claim 1, wherein said massage chair frame further comprises a head and neck body area portion extending upward from said back body area portion and located about said second end, and a lower leg body area portion located downward from said thigh body area portion and located about said first end.

3. The massage chair according to claim 1, wherein each of said at least one air massage element is selected from the group consisting of an air cell, an air bag, and any combination thereof.

4. The massage chair according to claim 1, wherein said noise-reducing, enclosure device is positioned in proximity of said massage chair frame.

5. The massage chair according to claim 4, wherein said noise-reducing, enclosure device is positioned below said seat or bottom body area portion of said massage chair frame.

6. The massage chair according to claim 1, wherein each of said first section and said second section of said enclosure housing further comprises a top, at least one side, an inner surface, and an outer surface.

7. The massage chair according to claim 1, wherein said noise-reducing material of each of said first section and said second section of said enclosure housing is selected from the group consisting of foam, noise-reducing foam, and any combination thereof.

8. A massage chair comprising:

a massage chair frame comprising a pair of opposing guide rails, wherein each of said guide rails comprises a first end, a second end, a bottom body area portion located about said first end, a curve portion located proximate said bottom body area portion and away from said first end, and a back body area portion extending upward from said curve portion; and a massage system in operational communication with said massage chair frame such that said massage system is capable of providing massaging effects to a user positioned in said massage chair, wherein said massage system comprises at least one air massage element, an air compressor or pump, and at least one air valve device for regulating air flow into and out of said at least one air massage element; and a noise-reducing enclosure device comprising an enclosure housing, wherein said enclosure housing comprises a first section and a second section, wherein said first section encloses said at least one compressor or pump while said second section encloses said at least one air valve device, wherein said first section comprises a noise-reducing material surrounding said at least one compressor or pump, and wherein said second section comprises a noise-reducing material surrounding said at least one air valve device.

9. The massage chair according to claim 8, wherein each of said guide rails further comprises a head and neck body area portion extending upward from said back body area portion and located about said second end, and a lower leg body area portion located downward from said thigh body area portion and located about said first end.

10. The massage chair according to claim 8, wherein each of said at least one air massage element is selected from the group consisting of an air cell, an air bag, and any combination thereof.

11. The massage chair according to claim 8, wherein said noise-reducing, enclosure device is positioned in proximity of said massage chair frame.

12. The massage chair according to claim 11, wherein said noise-reducing, enclosure device is positioned below said seat or bottom body area portion of each of said guide rails.

13. The massage chair according to claim 8, wherein each of said first section and said second section of said enclosure housing comprises a top, at least one side, an inner surface, and an outer surface.

14. The massage chair according to claim 8, wherein said noise-reducing material of each of said first section and said second section of said enclosure housing is selected from the group consisting of foam, noise-reducing foam, and any combination thereof.

15. The massage chair according to claim 8, wherein each of said at least one guide rail has a generally "L-shaped" configuration.

16. The massage chair according to claim 8, wherein each of said guide rails further comprises a guide channel extending from said bottom body area portion through to said back body area portion.

17. The massage chair according to claim 16, wherein said guide channel comprises a plurality of gear teeth.

18. The massage chair according to claim 1, wherein said noise-reducing material of each of said first section and said second section comprises a surface that is comprised of a plurality of pyramid-shaped configurations.

19. The massage chair according to claim 1, wherein said first section and said second section are positioned side by side with one another.

20. The massage chair according to claim 1, further comprising a touch controller in communication with said massage system, wherein said touch controller comprises at least one touch-sensitive area for being touched by the user to activate massage function.

21. The massage chair according to claim 8, wherein said noise-reducing material of each of said first section and said second section comprises a surface that is comprised of a plurality of pyramid-shaped configurations.

22. The massage chair according to claim 8, wherein said first section and said second section are positioned side by side with one another.

23. The massage chair according to claim 8, further comprising a touch controller in communication with said massage system, wherein said touch controller comprises at least one touch-sensitive area for being touched by the user to activate massage function.

* * * * *